United States Patent [19]

Santora

[11] 4,179,637

[45] Dec. 18, 1979

[54] INCANDESCENT LIGHT BULB WITH MULTIPLE FILAMENTS PROVIDING MULTIPLE LIVES

[76] Inventor: James V. Santora, 1228 Irvine Ave., Newport Beach, Calif. 92660

[21] Appl. No.: 896,368

[22] Filed: Apr. 14, 1978

[51] Int. Cl.[2] ..... H01K 9/00

[52] U.S. Cl. ..... 313/316; 315/64; 315/65

[58] Field of Search ..... 313/316; 315/64, 65, 315/66, 67, 69

[56] References Cited

U.S. PATENT DOCUMENTS

| | | | |
|---|---|---|---|
| 1,456,568 | 5/1923 | Quandt | 315/65 |
| 2,862,147 | 11/1958 | Conti | 315/65 |
| 3,886,400 | 5/1975 | Dill | 315/64 |
| 3,983,447 | 9/1976 | Mark et al. | 315/64 |

*Primary Examiner*—Saxfield Chatmon, Jr.
*Attorney, Agent, or Firm*—Jackson, Jones & Price

[57] ABSTRACT

An incandescent light bulb is provided with a plurality of filaments, the first of which is mounted between a first and a second current supply member to emit light upon passage of current therethrough. The remainder of the filaments comprise reserve filaments and are mounted between the first and the second current supply members with electrical connection being established only between the first current supply member and the reserve filaments. Biasing means are provided for urging the second current supply member in the direction of a longitudinal axis defined by the filaments, a biasing force generated by the biasing means being counteracted by the first filament and in later stages of the life of the light bulb by one of the reserve filaments. As a filament burns out and partially disintegrates the biasing force creates electrical contact between a reserve filament and the second current supply member and thereby renders operative a successive reserve filament.

21 Claims, 9 Drawing Figures

FIG. 6
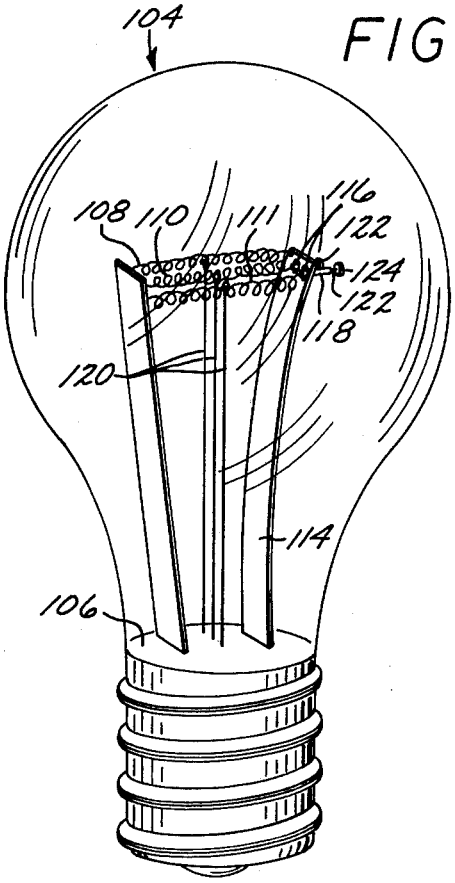
FIG. 9
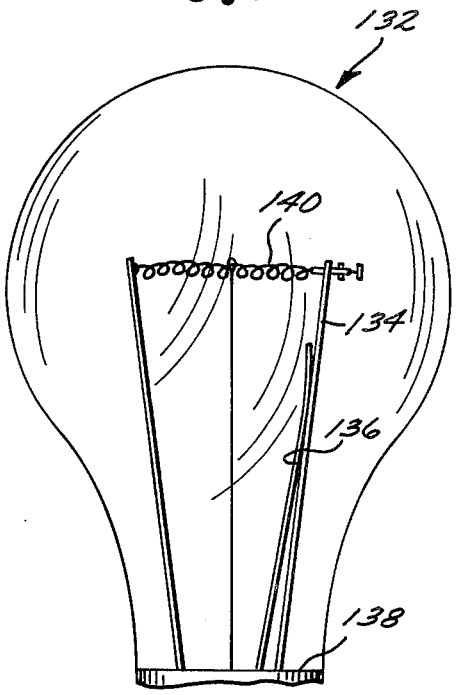
FIG. 7
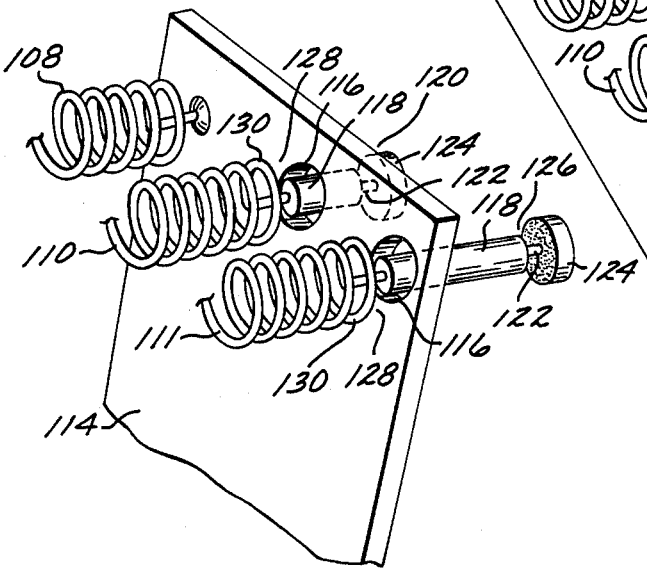
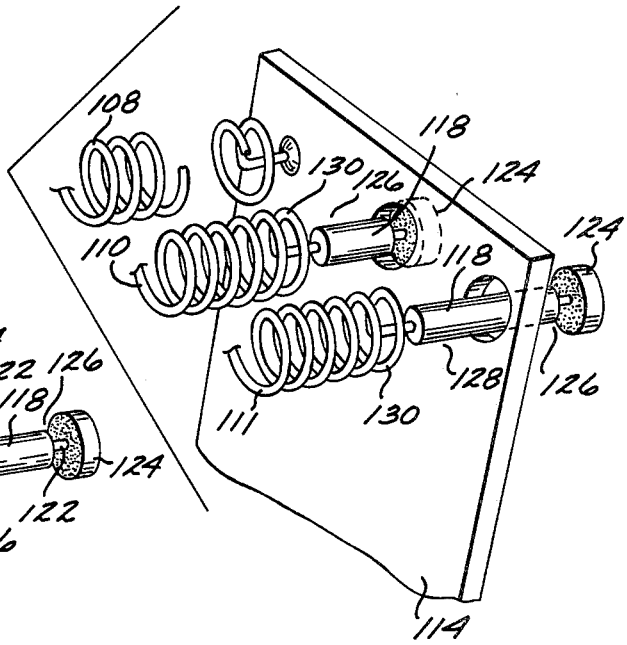
FIG. 8

INCANDESCENT LIGHT BULB WITH MULTIPLE FILAMENTS PROVIDING MULTIPLE LIVES

BACKGROUND OF THE INVENTION

1. Field of the Invention

The present invention relates to an incandescent light bulb, and more particularly to an incandescent light bulb having more than one light emitting filament wherein a second and any subsequent filament is activated for operative use only when a preceding filament burns out.

2. Description of the Prior Art

Incandescent light bulbs are well known in the prior art. In view of the great practical and economic siginficance of the incandescent light bulb a multitude of patent and other disclosures have described various designs of construction and modifications of the incandescent light bulb.

It is a well known fact that an incandescent light bulb has a limited life time, and after a certain number of hours of operation its more essential structural component, the light emitting filament burns out rendering the light bulb inoperative. It is readily understood that a prolonged useful life of an incandescent light bulb is desireble from an economic standpoint. Furthermore incandescent light bulbs are used in many situations where failure of the light bulb creates a safety hazare, for example failure of a light bulb in an automobile stop or tail-light or in an automobile headlight creates a traffic hazard of which the operator of the automobile may not even be aware. In many other situations as well, abrupt, inadvertent malfunction of an incandescent light bulb caused by a burnt-out filament creates a hazard and nuisance in that immediate replacement of the malfunctioning light bulb is either impossible or very inconvenient.

In an effort to prolong the useful life of the incandescent light bulb, the prior art has made many attempts and advances. For example a recent disclosure describing an incandescent lamp having increased life can be found in Winter U.S. Pat. No. 3,942,063. However the light bulb disclosed in the Winter patent as well as other light bulbs of the prior art merely provide a prolonged life of the filaments and do not incorporate a self-replacing feature.

It should be readily apparent from the above that the prior art has been constantly striving to design an incandescent light bulb having a truly extended life. All that effort and time spent in developing a prolonged life light bulb has not, until the present invention, resulted in a light bulb having a self-replacing feature incorporated in the light bulb of the present invention.

OBJECTS AND SUMMARY OF THE INVENTION

It is an object of this invention to provide an incandescent light bulb with greatly extended useful life.

It is another object of this invention to provide a savings in materials by providing an incandescent light bulb which has multiple lives.

It is yet another object of this invention to provide increased safety and convenience by designing a light bulb in which a reserve filament takes over the light emitting function of a burnt-out filament thereby providing extended life period for the light bulb.

It is still another object of this invention to provide a savings in man hours of labor expanded for changing light bulbs in vehicles, homes, factories, office buildings and like places. The above stated and other objects and advantages are attained by a light bulb having two current supply members and a light emitting filament permanently connected to the current supply members. A number of reserve filaments are permanently connected on one end to the first current supply member. A second end or an intermediate portion immediately contiguous to a second end of each reserve filament is provided with an electrically insulating and heat resistant cap which is in turn supported by the second current supply member. A biasing force urges the second current supply member in the direction of a longitudinal axis defined by the first light emitting filament and by the reserve filaments. The biasing force is counterbalanced by the first filament which operates in the first stage of the life of the light bulb. When the first filament burns out in the course of its normal life, the biasing force, by moving the second current supply member along the longitudinal axes of the reserve filaments, creates an electrical contact between a first reserve filament and the second current supply member thereby rendering the first reserve filament operative and capable of emitting light upon passage of current therethrough. The requisite biasing force may be generated by the second current supply member itself, for example by constructing the second current supply member from a metal having sufficient elasticity, bending the metal towards the longitudinal axis defined by the filaments, and mounting it in an appropriate fashion in an electrically insulating support base. Alternatively the biasing force may be generated by a spring which urges the second current supply member to move along the longitudinal axes of the filaments. Some preferred embodiments of the present invention may be provided with only one reserve filament.

The exact nature of this invention as well as other objects and advantages thereof will be best understood from consideration of the following specification when read in conjunction with the annexed drawings.

BRIEF DESCRIPTION OF THE DRAWINGS

FIG. 6 is a perspective of a fourth preferred embodiment of the present invention;

FIG. 7 is an enlarged perspective view of a section of FIG. 6 showing the mounting of the reserve filaments to the second current supply member;

FIG. 8 is an enlarged perspective view of the section shown in FIG. 7 with the first reserve filament being in operation, and FIG. 9 is a partial side view of a fifth preferred embodiment of the present invention.

DESCRIPTION OF THE PREFERRED EMBODIMENTS

The following specification taken in conjunction with the drawings set forth the preferred embodiment of the present invention in such a manner that any person skilled in the incandescent light bulb manufacturing arts can use the invention. The embodiments of the invention disclosed herein are the best modes contemplated by the inventor for carrying out his invention though it should be understood that various modifications can be accomplished within the parameters of the present invention.

Figure 1:
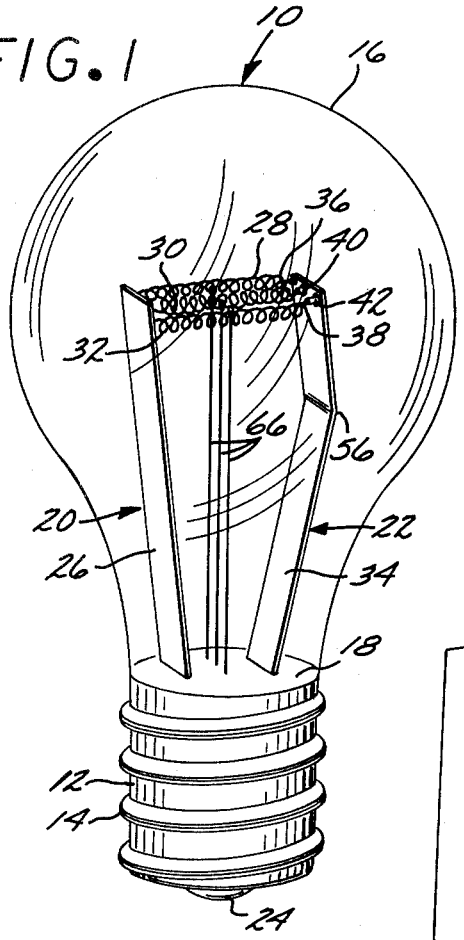
FIG. 1 is a perspective view of a preferred embodiment of the present invention having a permanently connected first filament and two reserve filaments.
Figure 2:
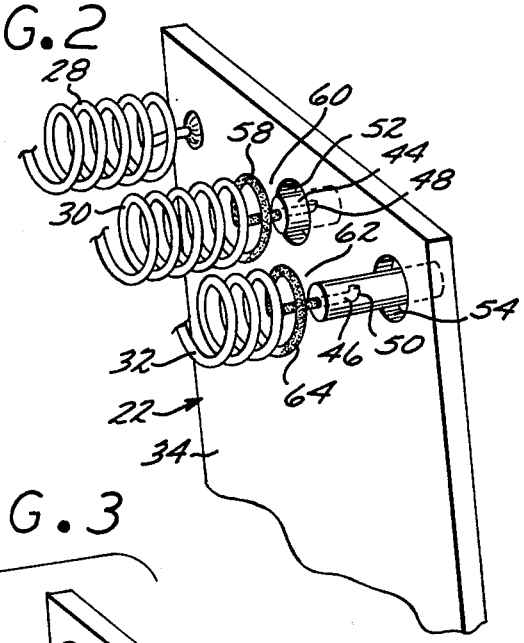
FIG. 2 is an enlarged perspective view of a section of FIG. 1 showing the mounting of the reserve filaments to the second current supply member.
Figure 3:
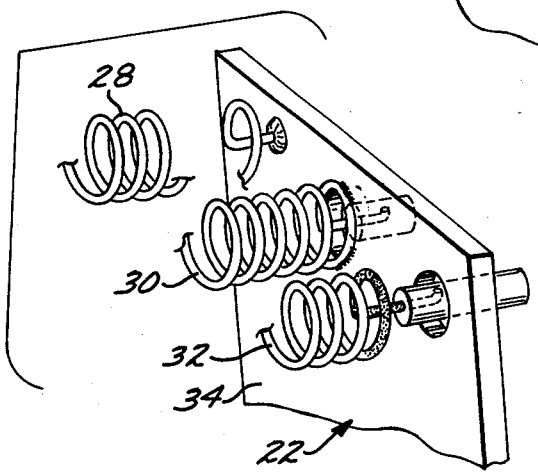
FIG. 3 is an enlarged perspective view of the section shown in FIG. 2 with the first reserve filament being in operation.

Referring first to FIGS. 1, 2 and 3 a preferred embodiment of the present invention is disclosed. A light bulb 10 having a base 12 provided with threads 14, a glass envelope 16 and an electrically insulating support base 18 is provided with electrically conductive first and second current supply members 20 and 22. The light bulb 10, as other conventional light bulbs, can be mounted into a socket (not shown) by the threads 14 and is provided with current through the electrically conductive threads 14 and a stem 24 disposed on the bottom of the base 12.

In this preferred embodiment of the present invention the first current supply member 20 has the shape of a plate 26 elongated in the direction of a longitudinal axis defined by the light bulb 10. A first light emitting filament 28 is mounted by welding or by some other suitable method known in the light bulb manufacturing arts to the first current supply member 20. A first reserve filament 30 and a second reserve filament 32 are likewise mounted to the first current supply member 20. In the preferred embodiment of the present invention described here, the first filament and the reserve filaments are disposed in a plane which is substantially perpendicular to the longitudinal axis defined by the light bulb 10. It should be, however, readily apparent to those skilled in the art that a different spatial arrangement of the filaments, with regard to the current supply members is possible, e.g. an arrangement where the filaments are disposed in a plane parallel to the longitudinal axis of the light bulb 10. Accordingly the invention is not intended to be limited to the spatial arrangement shown here.

The second current supply member 22 also has the shape of an elongated plate 34 disposed essentially parallel to the first current supply member 20. The first light emitting filament 28 is permanently connected to the second current supply member 22 by welding or by some other means well accepted and used in the light bulb manufacturing arts, so that when current is supplied through the current supply members 20 and 22 the first light emitting filament 28 emits light.

The first reserve filament 30 and the second reserve filament 32 are also connected by welding or other conventional means, respectively on one end of each to the first current supply member 20. However a respective second end 36 and 38 of each of the reserve filaments 30 and 32 is not electrically connected to the second current supply member 22. Instead the second ends 36 and 38 of the reserve filaments 30 and 32 are provided with a cap respectively 40 and 42 composed of an electrically insulating and heat resistant material. Suitable material for the construction of caps 40 and 42 may be glass, ceramic material, or a heat resistant plastic material such as polytetrafluoroethylene (Teflon) or the like.

The electrically insulating caps 40 and 42 are cylindrically shaped in this preferred embodiment of the present invention, and may be mounted to the ends 36 and 38 of the reserve filaments 30 and 32 by embedding the reserve filaments 30 and 32 in the cylindrical caps 40 and 42. Alternatively, in order to avoid the difficulty posed by the different heat expansion of the metalic material comprising the reserve filaments and the nonmetalic material comprising the heat resistant caps 40 and 42, small apertures 44 and 46 adapted for the receipt of hook shape ends 48 and 50 of the reserve filaments 30 and 32, may be provided in the cylindrical caps 40 and 42 respectively. As shown in particularity in FIGS. 2 and 3 the hook shaped ends 48 and 50 of the reserve filaments 30 and 32 are secured in the cylindrical caps 40 and 42 and the cylindrical caps respectively are supported by apertures 52 and 54, located in the second current supply member 22.

As it is readily apparent from the above description the first and second reserve filaments 30 and 32 are not in electrical contact with the second current supply member 22 and therefore upon energizing the light bulb with electrical current only the first filament 28 emits light.

In this preferred embodiment of the present invention the second current supply member 22 is constructed of a metal which is capable of retaining sufficient elastic, spring-like characteristics even under the high temperatures attained during the operation of the light bulb 10. The second current supply member 22 is bent to a sufficient extent and mounted in the electrically insulating support base in such a manner as to create a spring force which urges the second current supply member 22 to move towards the filaments. A bend 56 in an intermediate portion of the second current supply member 22 is illustrated in FIG. 1.

It is an essential feature of this invention that the spring tension which is continuously exerted by the second current supply member 22 is adjusted so that it is counterbalanced by the coiled, first light emitting filament 28 even when the first light emitting filament 28 and the second current supply member 22 are at elevated temperatures due to the operation of the light bulb 10.

The partial view of FIG. 3 illustrates the light bulb of this inventin after the first light emitting filament 28 has burned out in its normal course of expected life. As the first light emitting filament 28 burns out and partially disintegrates it no longer counterbalances the biasing force exerted by the second current supply member 22. Consequently the second current supply member 22 moves towards the first and second reserve filaments 30 and 32. The first reserve filament 30 is disposed in such a manner between the first 20 and the second current supply members 22 that the end of the electrically conducting coil 58 in closest proximity to the second current supply member 22 is at a sufficient distance 60 from the second current supply member 22 so as to prevent a formation of an arc and flow of electrical current between the first reserve filament 30 and the second current supply member 22 as long as the first light emitting filament 28 is intact.

As the first light emitting filament 28 is ruptured the second current supply member 22 approaches the first reserve filament 30 and during this process an electrical arc is generated. The electrically conductive end 58 of the first reserve filament 30 may be pretreated with a suitable flux so as to provide for welding of the electrically conducting end 58 of the first reserve filament 30 to the second current supply member 22 by the heat generated by the electric arc. As the second current supply member 22 moves towards and comes into electric contact with the first reserve filament 30 the electrically insulating cap 40 on the end of the first reserve filament 30 simply slides within the aperture 52 provided in the second current supply member 22. As mechanical and electrical contact is generated between the second current supply member 22 and the first reserve filament 30, further movement of the second current supply member 22 is prevented by the first reserve filament 30. As a result of the above described process current may flow through the first reserve filament 30 and the light bulb becomes operative again.

The second reserve filament 32 is disposed and constructed in essentially the same manner as the first reserve filament 30, however a distance 62 between the electrically conducting end 64 of the coil type second reserve filament 32 is larger than the distance 60 between the electrically conducting end 58 of the first reserve filament 30 and the second current supply member 22. The second distance 62 is designed so as to allow the second current supply member 22 to come into electrical contact with the electrically conducting end 64 of the second reserve filament 32 only after the first reserve filament 30 burns out in the course of the normal operation of the light bulb.

As the first reserve filament 30 is ruptured and therefore becomes inoperative the above described process for the activation of the first reserve filament is repeated whereby the second reserve filament comes into electrical contact with the second current supply member 22 rendering the light bulb operative again. It is contemplated within the scope of the present invention that a plurality of reserve filaments may be provided, their number being limited by such considerations as the distance between an electrically conductive end of a last reserve filament and the second current supply member which is to be eventually bridged by the movement of the second current supply member, as well as the relevant technology and economy of manufacturing a light bulb with a large number of reserve filaments.

It should be readily apparent from the above description that the biasing force capable of moving the second current supply member 22 towards the reserve filaments 30 and 32 is also suitable for maintaining electrical contact between the respective reserve filaments and the second current supply member 22. Therefore, although welding the coils of the reserve filaments 30 and 32 to the second current supply member 22 by the above described electric arc is desirable, it is not absolutely essential for the operation of this invention. The respective apertures 52 and 54 provided in the second current supply member 22 are smaller in diameter than the diameter of a coil comprising respectively the first 30 and second 32 reserve filaments. As a consequence, as soon as either reserve filament becomes operative, its electrically conductive end coil 58 will be juxtaposed to the second current supply member 22 and held thereto by the biasing force created by the second current supply member 22 thereby providing electrical contact.

The first light emitting filament 28 and the reserve filaments 30 and 32 of the specific embodiment shown in FIG. 1 are also supported in an intermediate portion of the respective filaments by support wires 66. The support wires 66, as conventionally done, are embedded in the electrically insulating base 18.

Figure 4:
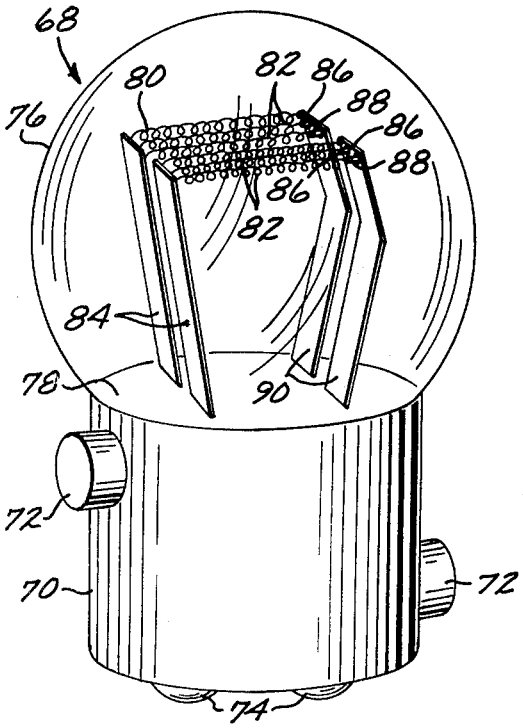
FIG. 4 is a perspective view of another preferred embodiment of the present invention having two sets of filaments, each set being independently connected to a power source.

FIG. 4 illustrates a second specific embodiment of the present invention. The light bulb 68 of the second specific embodiment is particularly adaptable for use as an automobile stop-light, tail-light combination or for various other uses wherein a conventional light bulb is provided with two coils each coil being independently connectable to a power source. Accordingly two pairs of current supply members and two sets of filaments are provided in the light bulb of the second preferred embodiment, each being independently connected to a current supply.

The light bulb 68 of the second specific embodiment further includes a cylindrical base 70 which is provided with a first pair of current conductive stubs 72 on the circular periphery of the cylindrical base 70, and with a second pair of current conductive stubs 74 on the bottom of the base 70. When mounted into an appropriate socket (not shown) the two pairs of current conductive stube 72 and 74 permit supplying each set of filaments with current independently from each other. Within a glass envelope 76 and embedded in an electrically insulating support base 78 are located the two pairs of current supply members. In a manner analogous to the mounting of the filaments to the current supply members in the first preferred embodiment of the present invention, three filaments are mounted respectively to each pair of current supply members. As in the first preferred embodiment the first light emitting filaments 80 here, are also permanently mounted between the current supply members, and the reserve filaments 82 are permanently mounted on one end to a respective first current supply member 84 and are provided with cylindrical caps 86 at their respective other ends. The cylindrical caps 86 are riding in apertures 88 which are provided in a respective second current supply member 90. Again the mounting of the reserve filaments 82 to the cylindrical caps 86 and the mounting of the cylindrical caps 86 in the apertures 88 are analogous to the arrangement described and shown in the first preferred embodiment.

Each second current supply member 90 of this second preferred embodiment is as in the first preferred embodiment, embedded in the electrically insulating support base 78 and is bent in an intermediate portion thereof and mounted in such a manner that a sufficient biasing force is created urging to move the second current supply member 90 towards the first light emitting filament 80 and the reserve filaments 82.

The light bulb 68 comprising this second preferred embodiment of the present invention operates in the same manner as the light bulb 10 comprising the first preferred embodiment. As described above, when either of the first light emitting filaments 80 burns out and ruptures in the course of its normal life, the biasing force created by the respective second current supply member is no longer counterbalanced by the coil of the light emitting filament 80 and the respective second current supply member 90 comes into mechanical and electrical contact with one of the reserve filaments 82.

As is readily apparent, the two sets of filaments of the light bulb 68 described here operate independently from each other. As briefly pointed out above the light bulb 68 of this second specific embodiment is particularly suitable for an automobile stop-light tail-light combination or some other use wherein two independently energizable light emitting filaments are required. Furthermore due to its "self-replacing" feature it is capable of reducing traffic hazards associated with the malfunction of a light bulb in a travelling automobile or in a situation where malfunction of an electrical light bulb creates a hazard and a nuisance.

Figure 5:
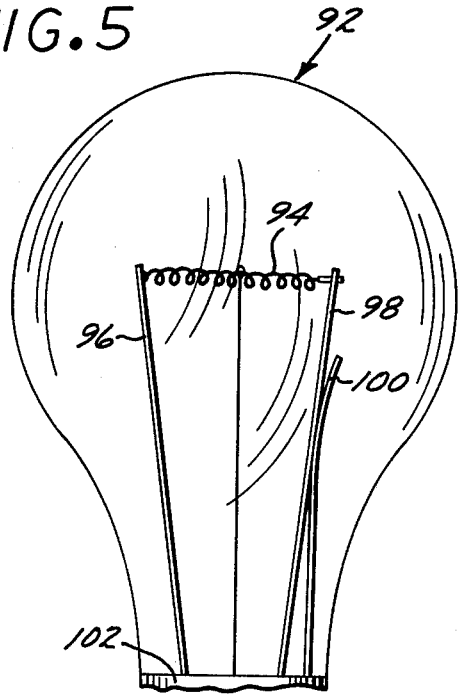
FIG. 5 is a partial side view of a third preferred embodiment of the present invention.

FIG. 5 illustrates a light bulb 92 comprising a third preferred embodiment of the present invention. In this preferred embodiment, as in the first preferred embodiment, three filaments, a first light emitting filament (not shown), and two reserve filaments 94 (only one of which is shown), are mounted between two current supply members 96 and 98 respectively. The mounting of these filaments is again identical to the mounting of the filaments described in the first and second preferred embodiments. In this preferred embodiment, however, the second current supply member 98 is not designed to exert a biasing force, instead a leaf spring 100 is provided to create the requisite spring force rendering the invention operable. The leaf spring 100 is embedded in an electrically insulating support base 102 provided in the light bulb 92, and is in contact with the second current supply member 98 biasing the second current supply member 98 towards the filaments 94. Here also, as in the above described preferred embodiments an essential feature of the present invention lies in the fact that the spring force generated by the leaf spring 100 biasing the second current supply member 98 toward the filaments 94 is carefully designed to be counterbalanced by a spring force exerted by the operative coil type first filament, and subsequently by an operative reserve filament. The operation of this third preferred embodiment described here is in other aspects identical to the operation of the previously described first and second preferred embodiments.

It should be readily apparent to those skilled in the arts that biasing means other than a leaf spring may be substituted for the leaf spring 100 shown in the third preferred embodiment, accordingly such biasing means are intended to be within the scope of the present invention.

FIGS. 6, 7 and 8 disclose a fourth preferred embodiment of the present invention. In the fourth preferred embodiment, as in the first, second and third embodiments, a light bulb 104 is provided with two current supply members embedded in an electrically insulating base 106 and a first light emitting filament 108 and a plurality of reserve filaments 110, 111 are mounted between the two current supply members. In a manner similar to the above described first, second and third preferred embodiments, the first filament 108 as well as the reserve filaments 110 and 111 are permanently and electrically connected to a first current supply member 112. However, only the first filament 108 is electrically connected to a second current supply member 114.

The second current supply member 114 is provided with a plurality of apertures 116, and an electrically insulating, cylindrical cap 118 is mounted upon each reserve filament 110 and 111. As in the previously described preferred embodiments, the electrically insulating caps 118 penetrate the apertures 116 and are supported therein, whereby the reserve filaments 110 and 111 are mounted to the second current supply member 114. Additional support is given to the first filament 108 and to the reserve filaments 110, 111 by support wires 120 which are connected to intermediate portions of the filaments 108, 110 and 111 and are also embedded in the electrically insulating base 106.

In the fourth preferred embodiment however, in contrast to the previously described preferred embodiments, the second current supply member 114 is designed to provide a biasing force urging it to move along the longitudinal axis defined by the filaments 108, 110 but not towards the first current supply member 112. Instead the biasing force which is obtained by bending the second current supply member 114 in an intermediate portion thereof and by appropriately fixedly mounting it in the electrically insulating base 106, urges the second current supply member 114 to move outward, away from the first current supply member 112. As long as the first light emitting filament 108 is intact and operative the biasing force is counterbalanced by the first filament 108.

As it is clearly shown in the detailed drawing of FIG. 7, the reserve filaments 110, 111 do not terminate within the electrically insulating caps 118, instead they penetrate therethrough and are provided at their respective ends 122 with electrically conductive knob like enlargements 124. The knob like enlargements 124 are affixed by welding or by other suitable means well known in the light bulb manufacturing arts to the reserve filaments 110, 111. The length of the electrically insulating caps 118, and a distance 126 between the second current supply member 114 and the respective knobs 124, and a distance 128 between the second current supply member 114 and those portions 126 of the reserve filaments 110, 111 which are disposed between the first 112 and second current supply members 114 in closest proximity to the second current supply member 114, are designed in such a way as to prevent the formation of an electric arc and the flow of current between the second current supply member 114 and the reserve filaments 110 as long as the first light emitting filament 108 is intact.

As shown in FIG. 8 after the first light emitting filament 108 burns out and partially disintegrates in the course of its normal life, the biasing force created by the second current supply member 114 is no longer counterbalanced by the first filament 108 and the biasing force moves the second current supply member 114 outwards along the longitudinal axis of the reserve filaments 110, 111 until the second current supply member 114 comes into contact with the knob 124 provided on the end of the first reserve filament 110. Thus current may flow between the second current supply member 114 and the first reserve filament 110 and the light bulb 104 becomes operative again. In order to provide better electrical contact the knobs 124 on the end of the reserve filaments may be pretreated with a suitable flux so that an electric arc generated upon initial contact between the knobs 124 and the second current supply member 114 may weld the knobs 124 to the second current supply member 114.

As it is illustrated on FIG. 8 when the first reserve filament 110 is in operation the second reserve filament 111 is available and may be activated for operative use in the same manner as the first reserve filament 110 has been activated.

As FIGS. 6, 7 and 8 clearly illustrate, in the fourth preferred embodiment of the present invention the reserve filaments 110 and 111 are progressively longer with the first reserve filament 110 adjacent to the permanently mounted first filament 108 being the shortest. As in the previously described preferred embodiments a plurality of reserve filaments may be provided in this fourth preferred embodiment also, their number being limited by such considerations as the distance between the knob 124 mounted on the end of a last reserve filament and the second current supply member 114, which is to be eventually bridged by the movement of the second current supply member, as well as the relevant technology and economy of manufacturing a light bulb with a large number of reserve filaments.

Referring to the side view of FIG. 9 a fifth preferred embodiment of the present invention is disclosed. The design and construction of the light bulb 132 of this fifth preferred embodiment is essentially identical to the design and construction of the light bulb 104 of the fourth preferred embodiment differing therefrom only in that in the fifth preferred embodiment a second current supply member 134 does not create the biasing force requisite for the operation of the invention.

Instead a leaf spring 136 is mounted within an electrically insulating support base 138 of the light bulb 132, and the leaf spring 136 urges to move the second current supply member 134 along the longitudinal axis defined by the filaments 140 (only one of which is shown in FIG. 9). In every other aspect the operation of the light bulb 132 comprising this fifth preferred embodiment of the present invention, is analogous to the operation of the light bulb 104 comprising the fourth preferred embodiment. As it has been pointed out above, biasing means other than a leaf spring may be substituted for the leaf spring 136 shown here and accordingly other biasing means are intended to be within the scope of the present invention.

What has been described above is an electrical light bulb containing multiple light emitting filaments with only one filament being operative in the first stage of the bulb's useful life. Additional filaments become operative in a successive fashion as a preceding filament burns out. It will be readily apparent to those skilled in the art that various modifications of the present invention are possible in light of the above disclosure and accordingly the scope of the invention should be interpreted solely from the following claims.

What is claimed is:

1. An incandescent light bulb comprising:

a first current supply member;

a second current supply member having at least one aperture;

a first electrically conductive filament capable of emitting light upon passage of current therethrough, the filament being permanently and electrically connected to the first and second current supply members;

at least one additional, electrically conductive reserve filament capable of emitting light upon passage of current therethrough, the reserve filament being electrically connected to the first current supply member and having an electrically insulating member which penetrates the aperture whereby the reserve filament is supported by the second current supply member but is not electrically connected thereto, and connecting means for electrically connecting the reserve filament to the second current supply member when the first filament becomes inoperative whereby the reserve filament becomes operative to emit light upon passage of current therethrough.

2. The invention of claim 1 wherein the connecting means comprise means to bias the second current supply member along a longitudinal axis defined by the first filament and by the reserve filament, a biasing force exerted by the biasing means being counteracted by the intact, operative first filament, the biasing means moving the second current supply member into contact with the reserve filament when the first filament is burnt out and becomes inoperative, thereby creating electrical contact between the second current supply member and the reserve filament and rendering the reserve filament operative to emit light upon passage of current therethrough.

3. The invention of claim 2 wherein the second current supply member comprises the biasing means.

4. The invention of claim 3 wherein the second current supply member is composed of an elastic metal, bent toward the longitudinal axis defined by the first filament and by the reserve filament and mounted so as to generate a biasing force urging the second current supply member towards the reserve filament.

5. The invention of claim 3 wherein the electrically insulating member is composed of heat resistant inorganic material.

6. The invention of claim 3 wherein the electrically insulating member is composed of heat resistant plastic material.

7. The invention of claim 3 wherein the reserve filament is provided with means for welding the reserve filament to the second current supply member upon an initial passage of current through the reserve filament.

8. The inventin of claim 3 incorporating only one reserve filament.

9. The invention of claim 2 incorporating a plurality of reserve filaments, each reserve filament being progressively shorter than the preceding reserve filament, a first reserve filament adjacent to the first filament being the longest, the biasing means generating electrical contact between the second current supply member and another still operative reserve filament when a preceding reserve filament burns out thereby rendering it capable of emitting light upon passage of current therethrough.

10. The invention of claim 2 incorporating a plurality of reserve filaments, each reserve filament being progressively longer than the preceding reserve filament, a first reserve filament adjacent to the first filament being the shortest, the biasing means generating electrical contact between the second current supply member and another still operative reserve filament when a preceding reserve filament burns out thereby rendering it capable of emitting light upon passage of current therethrough.

11. The invention of claim 2 wherein the means for biasing the second current supply member comprise a spring.

12. The invention of claim 11 wherein the spring comprises a leaf spring.

13. The invention of claim 11 wherein the electrically insulating member is composed of heat resistant inorganic material.

14. The invention of claim 11 wherein the electrically insulating member is composed of heat resistant plastic material.

15. The invention of claim 11 wherein the reserve filament is provided with means for welding to the second current supply member upon an initial passage of current through the reserve filament.

16. The invention of claim 11 incorporating only one reserve filament.

17. The invention of claim 11 incorporating a plurality of reserve filaments, each reserve filament being progressively shorter than the preceding reserve filament, a first reserve filament adjacent to the first filament being the longest, the biasing means generating electrical contact between the second current supply member and another still operative reserve filament when a preceding reserve filament burns out thereby rendering it capable of emitting light upon passage of current therethrough.

18. The invention of claim 11 incorporating a plurality of reserve filaments, each reserve filament being progressively longer than the preceding filament, a first reserve filament adjacent to the first filament being the shortest, the biasing means generating electrical contact between the second current supply member and another still operatvie reserve filament when a preceding filament burns out thereby rendering it capable of emitting light upon passage of current therethrough.

19. An improved incandescent light bulb comprising:

a first current supply member;

a second current supply member;

a first light emitting filament mounted between the first and second current supply members and having electrical connection to said first and second current supply members, the first light emitting filament having a general longitudinal axis;

at least one reserve filament mounted between the first and second current supply members and being electrically connected only to the first current supply member, the reserve filament having a general longitudinal axis substantially parallel with the general longitudinal axis of the first filament, the reserve filament having insulating means for mounting the reserve filament to the second current supply member, the insulating means being adapted for motion relative to the second current supply member, and spring biasing means for moving the second current supply member relative to the reserve filament in a direction substantially parallel with the general longitudinal axis of the reserve filament and for bringing the reserve filament into electrical contact with the second current supply member when the first filament becomes inoperative.

20. The light bulb of claim 19 wherein the second current supply member has at least one aperture and wherein the insulating means comprise an insulating body slideably mounted in the aperture.

21. The light bulb of claim 20 wherein the spring biasing means is included in the second current supply member.

* * * * *